US005678358A

United States Patent [19]

Koledin

[11] Patent Number: 5,678,358

[45] Date of Patent: Oct. 21, 1997

[54] SOLDIER FIGHTING COVER

[76] Inventor: Michael J. Koledin, P.O. Box 1414, Cornelius, N.C. 28031

[21] Appl. No.: 560,009

[22] Filed: Nov. 17, 1995

[51] Int. Cl.[6] ..... E04D 1/34

[52] U.S. Cl. ..... 52/4; 52/169.6; 52/3; 135/115; 135/122

[58] Field of Search ..... 52/3–5, 169.6, 52/169.7, DIG. 11, 143; 135/115, 121, 122, 118; 4/494, 496, 498, 503, 488; 14/2.3

[56] References Cited

U.S. PATENT DOCUMENTS

| | | | |
|---|---|---|---|
| Re. 30,774 | 10/1981 | Dahlbeck et al. | 4/498 |
| 181,518 | 8/1876 | Ballman . | |
| 252,168 | 1/1882 | Angus . | |
| 950,684 | 1/1910 | Van Dusen . | |
| 1,732,288 | 10/1929 | Steser . | |
| 2,866,320 | 12/1958 | Bazzell | 61/41 |
| 3,161,990 | 12/1964 | Morris, Jr. | 50/100 |
| 3,172,740 | 3/1965 | Elstner | 34/233 |
| 3,660,951 | 5/1972 | Cadwell | 52/2 |
| 3,681,883 | 8/1972 | Ehruch | 52/143 |
| 3,726,054 | 4/1973 | Anderson et al. | 52/DIG. 11 |
| 3,757,475 | 9/1973 | Hackworth | 52/DIG. 11 X |
| 3,769,764 | 11/1973 | Young | 52/DIG. 11 X |
| 3,830,024 | 8/1974 | Warnke | 52/143 X |
| 3,869,836 | 3/1975 | Allen | 52/DIG. 11 X |
| 3,922,866 | 12/1975 | Benning | 61/41 |
| 3,977,149 | 8/1976 | Haynes et al. | 52/731 |
| 4,148,162 | 4/1979 | Goodrich | 52/DIG. 11 X |
| 4,188,159 | 2/1980 | Clarke et al. | 405/282 |
| 4,222,401 | 9/1980 | Alliveil | 135/1 |
| 4,319,791 | 3/1982 | Gibson | 312/239 |
| 4,433,700 | 2/1984 | Dohet | 135/97 |
| 4,442,162 | 4/1984 | Kiester | 428/245 |
| 4,555,201 | 11/1985 | Paoluccio | 405/117 |
| 4,625,468 | 12/1986 | Klampel | 52/2 |
| 4,871,101 | 10/1989 | Bunz et al. | 224/153 |
| 4,879,154 | 11/1989 | Bennett | 428/81 |
| 5,014,470 | 5/1991 | Lane et al. | 52/DIG. 11 X |
| 5,240,756 | 8/1993 | Finnell et al. | 428/45 |
| 5,303,527 | 4/1994 | Perez et al. | 4/498 X |
| 5,311,699 | 5/1994 | Huffman | 52/63 X |
| 5,422,164 | 6/1995 | Stanton | 428/182 |

*Primary Examiner*—Wynn E. Wood
*Assistant Examiner*—Yvonne Horton-Richardson
*Attorney, Agent, or Firm*—Joseph F. McLellan

[57] ABSTRACT

A portable soldier fighting cover having a pair of adjacent relatively rigid frames attached to an underlying waterproof flexible anchorage sheet, and defining a structure resistant to bending for spanning a military trench or foxhole, and further having a load bearing sheet attached to and overlying each frame for transmitting loads to the frame resulting from the weight of protective material such as sandbags or timber placed on the cover, and also from ballistic fragments and blast overpressure from near misses, and further having a pair of elongated straps attached to each frame and extending beyond the ends of the frames for securement to the ground for transmitting loads from the frame to the ground and for supporting the cover in the event of collapse of the foxhole side walls. Curtain sheets can be attached to the straps for service as revetments.

20 Claims, 4 Drawing Sheets

SOLDIER FIGHTING COVER

BACKGROUND OF THE INVENTION

The present invention relates to a portable soldier fighting cover for a ground excavation, and more particularly to a portable rigid type of fighting soldier cover for spanning a military trench or foxhole to bear heavy loads from overlying sand bags or the like, and from near-miss blast overpressure. The cover is characterized by load bearing straps adapted to be extended outwardly and over the adjacent ground where they are staked in position to support the cover in the event of collapse of the foxhole side walls.

Typically, one or two combat infantrymen use a trench or foxhole with some kind of overlying cover to protect them from high velocity projectiles and the blast overpressure of missiles exploding overhead.

Various forms of foxhole cover are known in the prior art, including the use of trees thrown over the foxhole and covered with earth or sandbags, a portable and flexible roll up cover such as is disclosed in U.S. Pat. No. 4,879,154 (Bennett), and semirigid shallow arch covers such as are taught in U.S. Pat. No. 5,422,164 (Stanton) and U.S. Pat. No. 4,433,700 (Dohet).

A satisfactory cover should be portable enough that it can be carried by a foot soldier. It should be compact to enable a number of such covers to be compactly arranged for loading onto trucks for transport in the field. The cover also should be quickly and easily installable, and be sufficiently rigid to bear the considerable weight of overlying protective material such as earth and sandbags. The cover should employ waterproof materials to shield the foxhole occupants from rain. It is also important that some means be provided to anchor the cover in position so that it cannot fall down into the foxhole in the event that the foxhole sidewalls collapse.

SUMMARY OF THE INVENTION

According to the present invention, a portable cover is provided which utilizes a relatively rigid frame structure to span a trench or foxhole and bear the heavy load of overlying protective earth and sand bags or the like. Tough, light weight material such as relatively thick plastic is used to support some of the load and effectively transfer the load to the frame structure.

A waterproof fabric is provided which overlies the frame and plastic structures to shield the soldier or soldiers in the foxhole from rain, the fabric also being useful prior to deployment of the cover to transport the cover components in compact relation.

A significant feature of the cover is its employment of a plurality of high tensile strength elements in the form of elongated straps coupled to the cover components, and adapted to extend across the ground adjacent to the foxhole for staking of the straps to the ground to anchor the cover against falling into the foxhole in the event of any collapse of the foxhole side walls.

When needed, the straps also serve to support curtain sheets or revetments in suspended relation adjacent the foxhole side walls to constrain the side walls against collapse.

Other features and advantages of the invention will become apparent from the following detailed description, taken in conjunction with the accompanying drawings, which illustrate, by way of example, the features of the invention.

DETAILED DESCRIPTION

Figure 1:
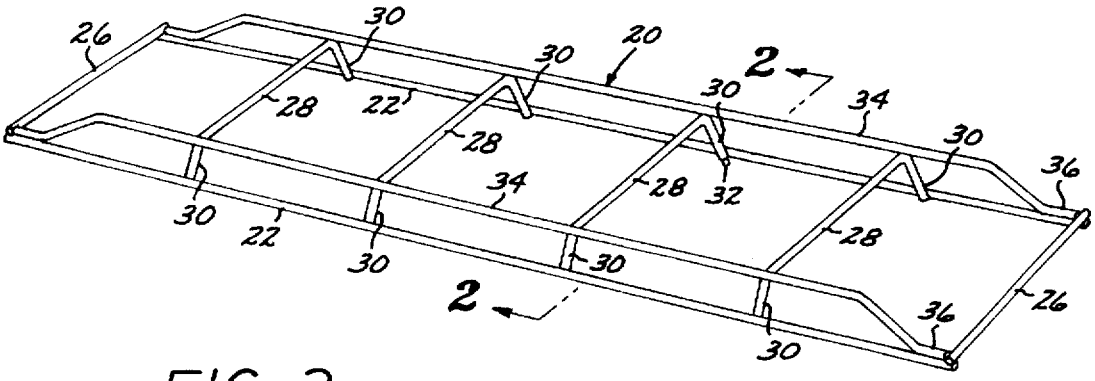
FIG. 1 is a perspective view of one of the two frames of the cover.

As shown in the drawings for purposes of illustration, the invention is embodied in a cover 10 which spans or bridges a military trench or two man foxhole 12. The cover 10 includes a plurality of elongated elements or straps 14 which are staked to the earth or ground 16 adjacent the foxhole 12 to prevent the cover 10 from falling upon the foxhole occupants in the event the foxhole sides 18 collapse.

The cover 10 is light in weight and therefore easily carried by one man. A significant portion of the strength and rigidity which characterize the cover are provided by a pair of side-by-side frames 20, preferably made of tubular carbon steel or 6061 T6 aluminum or equal.

When made of aluminum frames the cover weighs about 26 pounds, while one made of steel frames weighs about 33 pounds. The overall dimensions of the cover are 35 to 40 inches wide, and 48 inches long to span a typical foxhole that is 24 inches wide. The cover is capable of supporting 5000 pounds with a deflection of approximately ½ inch, and also capable of withstanding the blast overpressure of a 155 millimeter shell exploding 15 feet overhead.

The foregoing dimensions, and the other specifications which follow, are merely exemplary and are primarily intended for guidance, and not by way of limitation. Moreover, the terms "up" and "down" are used with reference to the cover in its deployed or operative position.

Figure 2:
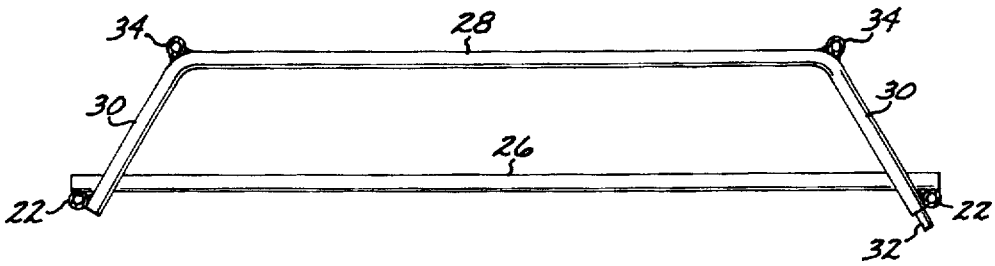
FIG. 2 is an enlarged view taken along the line 2—2 of FIG. 1.

Referring now in particular to FIGS. 1 and 2, each frame 20 comprises a pair of parallel, transversely spaced apart and longitudinally extending lower rails or tubes 22. The ends of a pair of parallel, transversely extending transverse tubes 26 are welded to the inwardly located surfaces of the ends of the lower tubes 22, respectfully.

Four transverse tubes of inverted U-shape 28 are spaced apart substantially equally along the length of the frame. Their extremities are outwardly directed to form inclined portions or angle tubes 30 whose free ends are welded at their outer surfaces to the inner surfaces of the lower rails 22.

Figure 12:
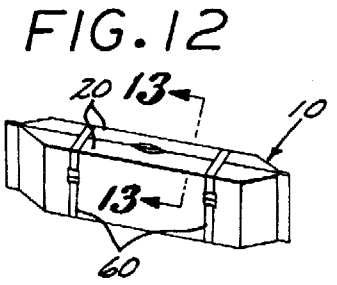
FIG. 12 is a perspective view of the two frames of the cover brought together in a compact package for carrying.
Figure 13:
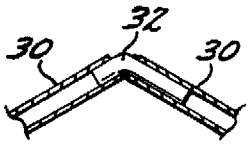
FIG. 13 is a detail view taken along the line 13—13 of FIG. 12.

An end portion 32 of one of these angle tubes 30 is smaller in diameter than the diagonally opposite angle tube 30 of the other frame so as to fit/within the open end of this diagonally opposite angle tube 30 when the two frames are brought together, as seen in FIGS. 12 and 13. This properly orients and maintains the two frames together when they are folded into a compact package for carrying, as seen in FIG. 12.

Each frame further comprises a pair of parallel, longitudinally extending upper rails or tubes 34 disposed above and inwardly of the lower tubes 22 so that the downwardly directed surfaces of the tubes 34 can be welded to the adjacent upwardly directed surfaces of the angle tubes 30 where they are curved to meet the horizontal portions of the transverse U-shaped tubes 28. The extremities of the upper tubes 34 are angled downwardly and inwardly, and then longitudinally, to form end portions 36 whose upwardly directed surfaces underlie and are welded to the undersurfaces of the end transverse tubes 26. The downwardly directed surfaces of the portions 36 overlie and are welded to the upwardly directed surfaces ,of the ends of the lower tubes 22.

The foregoing orientation of the tubes has been found to provide surprising strength such that the cover 10, as previously indicated, will support a load of at least 5000 pounds, most of this load being constituted of earth and sand bags piled upon the cover to protect the foxhole occupants, as will be seen.

The loads upon the cover are borne to a significant extent by a pair of elongated, generally rectangular load bearing sheets 38, one for each of the frames 20. Each sheet 38 is made of tough, waterproof, relatively thick polypropylene plastic material about 0.065 inches thick. Each sheet 38 is flexible enough to be reversely formed at its free ends around the end transverse tubes 26, where the sheet 38 is held in place by riveting its free ends to the parent portion of the associated sheet 28.

Each sheet 38 overlies the upper surfaces of the pair of upper tubes 34 throughout their length to thereby better transfer loads from the load bearing sheet 38 to the structure of the associated frame 20. In addition, this arrangement provides sloping surfaces at the ends of the waterproof sheets 38 to afford protection from the weather, and to direct water runoff away from the foxhole. Such runoff is also facilitated by a tipping of the cover on initial placement over a plurality of sandbags, as will be seen.

Figure 3:
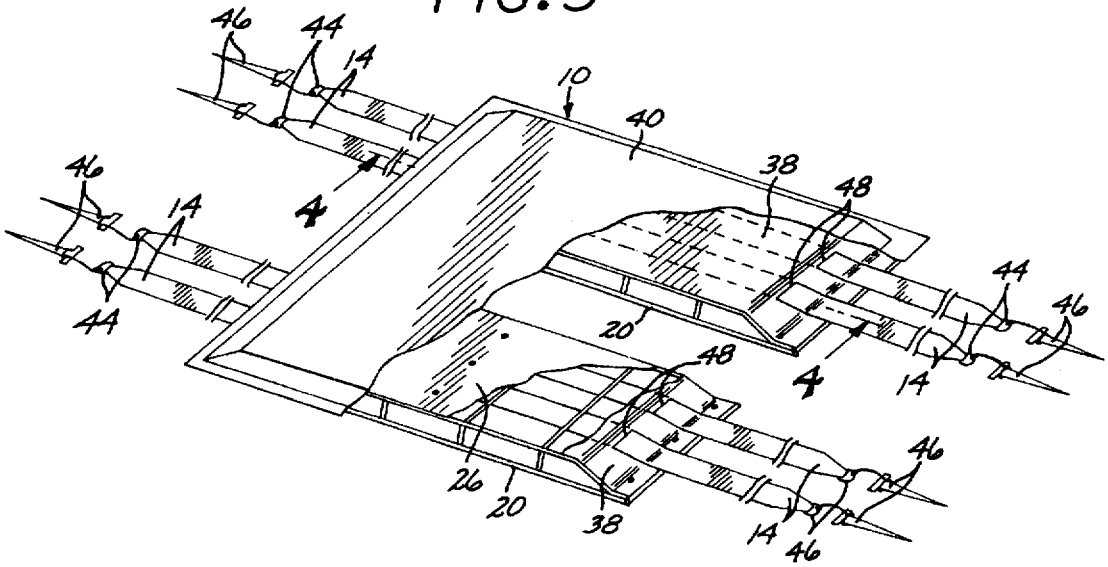
FIG. 3 is a perspective view of the cover, the extended straps being foreshortened to fit within the drawing space, and portions of the anchorage and load bearing sheets being cut away for clarity.

As best seen in FIG. 3, a generally rectangular weatherproof anchorage sheet 40 is disposed on top of the side-by-side flames 20. The frames are typically spaced about 4 inches apart, but they are movable relative to the sheet 40 to reduce this space if desired. Each sheet 40 is tough and waterproof, preferably being made of urethane coated polypropylene fabric. It is long enough to extend somewhat beyond the ends of the adjacent frames 20, and wide enough to extend sufficiently beyond the sides of the outermost frames 20 so that it can be arranged upwardly along the angle tubes 30 for riveting at its free extremities to the upper extremities of the tubes 30.

As previously indicated, the frames 20 are otherwise loosely positioned beneath the sheet 40 such that they can be moved toward and away from each other for optimum positioning, the typical distance between the frames being about 4 inches.

The sheet 40 also forms a convenient carrying package. The frames 20 can be folded toward each other, and held in compact relation by the interfitting of the ends of the angle tubes 30, as previously explained. A pair of packaging straps 60, as seen in FIG. 12, are connected in longitudinally spaced apart relation to one of the lower tubes 22, each strap having male and female connectors at its opposite ends. The straps are trained around the folded together frames and fastened together at their opposite ends to enable the assembled cover to be easily carried by one man.

It will therefore be apparent that the sheet 40 bears the weight of earth and sandbags in the space between the adjacent frames 20, holds the frames in position, diverts rain water away from the foxhole and its occupants, and provides an easy and convenient means for carrying the cover from place to place.

As previously indicated, the cover 10 is adapted to carry a considerable load of overlying protective material to protect the foxhole occupants. In addition, it includes elements which prevent the cover from falling into the foxhole in the event the load on the cover becomes too great, because of such things as rain absorption by the overlying earth, or excessive blast pressure from overhead explosions or the like.

As best illustrated in FIGS. 3–6, these elements comprise a plurality of the polypropylene webbing elements or straps 14, preferably about 3 inches wide and having a tensile strength of about 2200 pounds. Each strap extends about 7 feet beyond the ends of the frames 20.

The ends of each of the straps are folded back upon themselves over a pair of high strength forged steel "D" rings 44, respectively, and stitched in place by strong polyethylene thread to hold the "D" rings in place.

The straps 14 and their associated "D" rings are extended and arranged on the ground in position on either side of the foxhole. A plurality of stakes 46, preferably about 12 inches long, are driven through the central openings defined by the shape of the "D" rings 44, respectively, and into the ground to anchor the cover in position, and constraining it against any inward movement toward the foxhole.

Four straps 14 are provided, two for each of the frames 20. The pair of straps for each frame are spaced apart and extend inwardly from the "D" rings 44 at their ends through a pair of adjacent transverse slits 48 cut or otherwise provided in the adjacent extremity of the load bearing sheet 38. The straps then extend from the slits 48 in that extremity to similar slits 48 provided in the opposite extremity of the sheet 38. All of the slits 48 lie in approximately the same horizontal plane as the upper surfaces of the transverse tubes 28.

Figure 4:
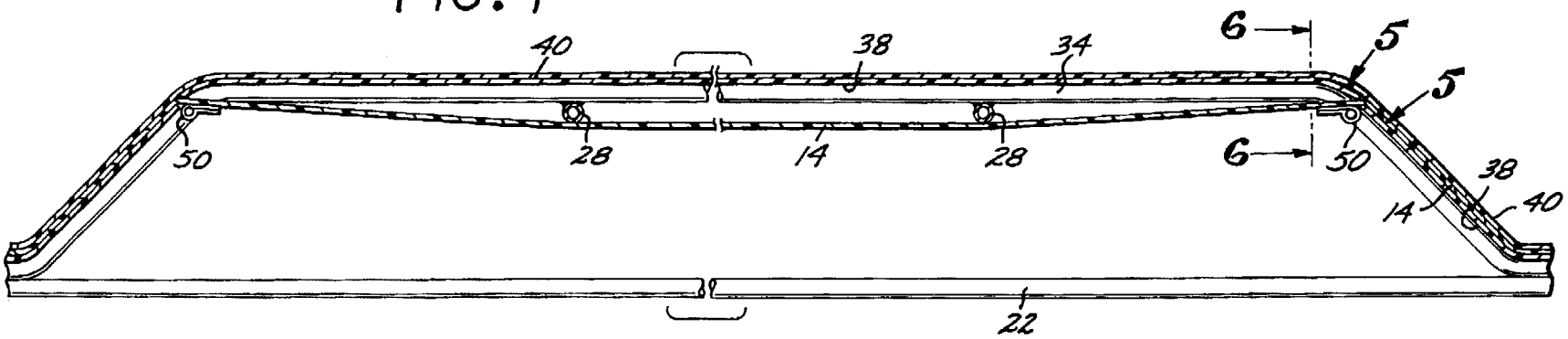
FIG. 4 is an enlarged view taken along the line 4—4 of FIG. 3.
Figure 6:
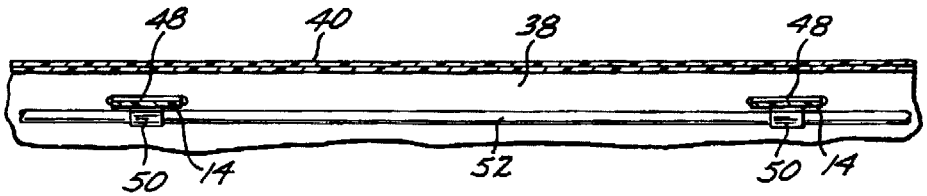
FIG. 6 is an enlarged view taken along the line 6—6 of FIG. 4.
Figure 5:
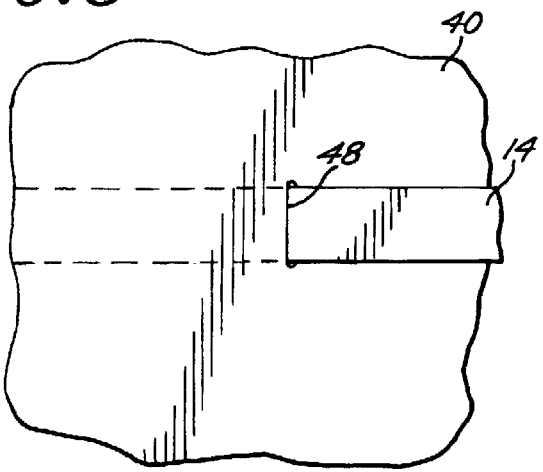
FIG. 5 is an enlarged view taken along the line 5–5 of FIG. 4.

Inwardly of each set 48, a loop 50, FIG. 4, made of the same material as the strap 14 is stitched to the associated strap 14. When each strap is initially fitted through the slits 48, the associated loops 50 must be forcibly pulled through the slits because of the close fit of their double thickness, compared to the thickness of the strap 42. Once in position the loops engage the margins of the associated slits 48 and prevent the straps from being pulled Outwardly through the sets.

Thus, there are four straps 14 extending through four slits in the two load bearing sheets 38 at opposite ends of the cover. The straps are constrained against movement outwardly of the cover by the four loops 50. It is important to note that the portions of the straps 14 between the loops 50 pass beneath all of the transverse tubes 28 in order to constrain the cover from falling in to the foxhole.

Figure 9:
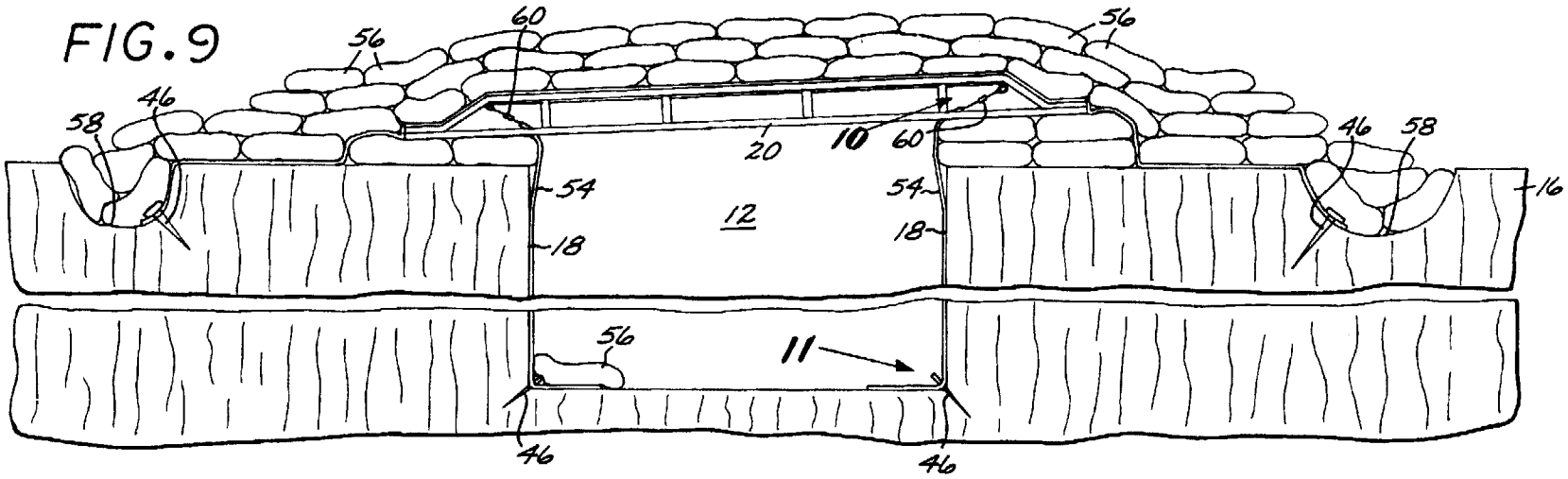
FIG. 9 is a view similar to FIG. 8, but with additional sandbags placed over the cover, and illustrating the use of revetment sheets attached to and suspended from the straps of the cover.
Figure 10:
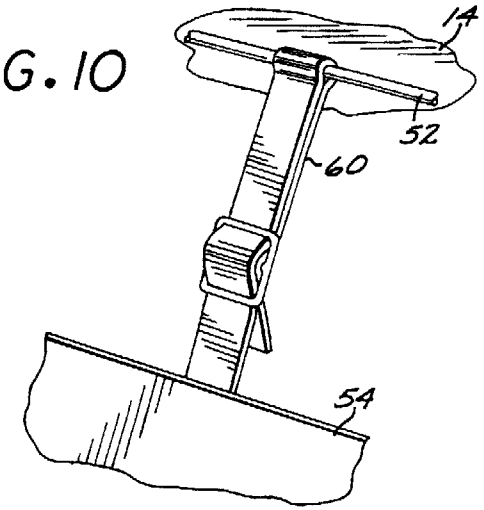
FIG. 10 is an enlarged view taken in the area indicated by the arrow and numeral 10 in FIG. 9.

The four loops 50 at each end of the cover each extend downwardly for slidable receipt of a rod 52 trained through the loops 50. A plurality of straps 60 extend around each rod 52 at regularly spaced intervals, one end of each of the straps being stitched to the upper edge of an associated one of a pair of revetment sheets 54, as seen in FIGS. 9 and 10. This attachment arrangement is present at each end of the cover so that the pair of revetment sheets 50 are supported in engagement with the foxhole sides 18.

Referring now to FIGS. 7–11, a preferred method of installation of the cover 10 over the foxhole 12 is illustrated. Various other installation methods will suggest themselves to those skilled in the art, the present method being merely exemplary.

After the foxhole 12 is dug, two rows of sandbags 56, three bags long and two bags high are arranged on one side of the foxhole. Then two rows of sandbags 56, three bags long and one bag high, are arranged on the other side of the foxhole. This initial placement of sandbags adjacent the foxhole edges reduces the chances of collapse of the side walls of the foxhole, and also provides a difference in elevation to facilitate drainage of water over the cover 10.

If desired, the headroom in the foxhole can be increased by increasing the layers of sandbags on either side of the foxhole, making sure that there is one less layer on one side to tip the cover to provide a runoff for rainwater. The height of the sandbags underlying the cover should preferably not exceed about 24 inches from ground level to the top of the sandbags.

Figure 7:
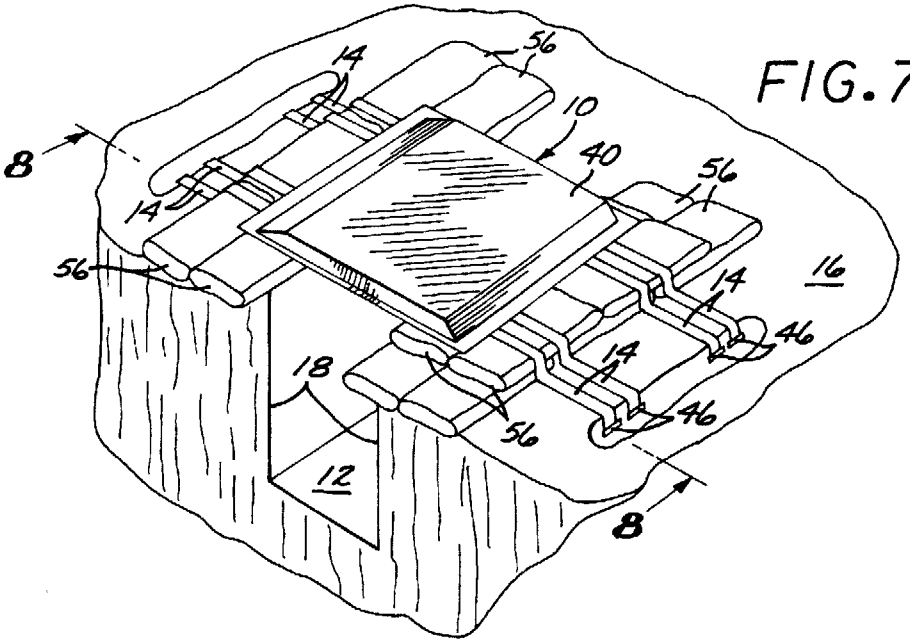
FIG. 7 is a perspective view of the cover as it would appear when placed over sandbags located on either side of a military foxhole.
Figure 8:
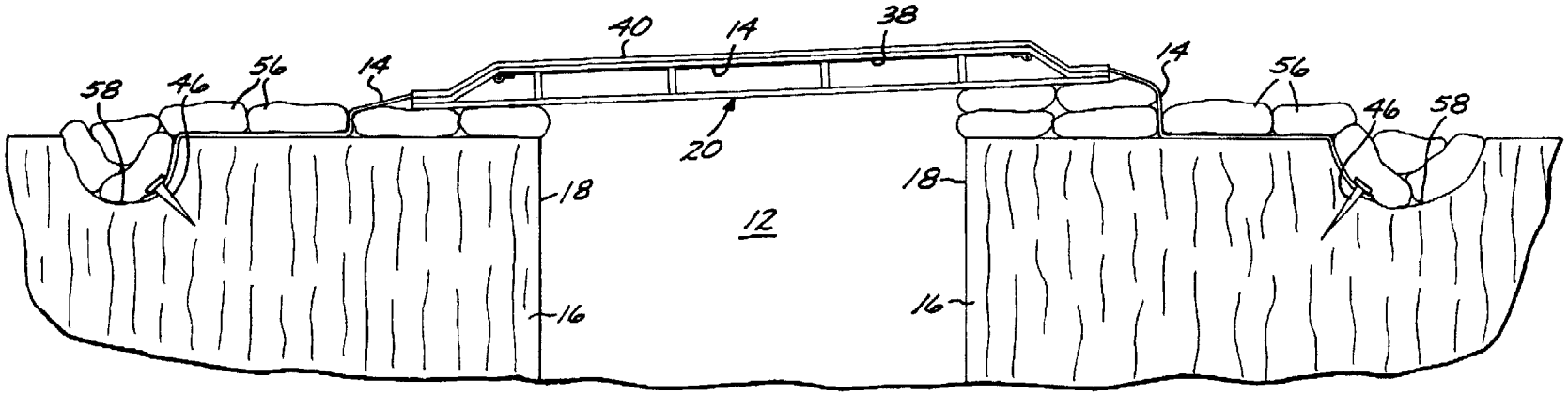
FIG. 8 is an enlarged view taken along the line 8—8 of FIG. 7.

The portable assembly or package containing the interfitted frames 20 and the sheet 40, as seen in FIG. 1, are next placed across the foxhole and then opened with the sheet 40 facing downwardly. The frames 20 are next pulled apart to the spacing desired, the maximum width of cover available by this means being about 40 inches. The straps 14 are next deployed to their maximum length, and the assembly is flipped over into its operating position, as seen in FIGS. 7 and 8.

Additional sandbags are preferably placed over the straps 14, as illustrated. With the straps fully extended and tight, the stakes 46 are driven through the "D" rings 44 into the ground. Alternatively, if the soil is wet or soft, a hole 58 should be dug at the end of each strap, and the strap staked to the bottom of the hole. One or more sandbags are then placed over the staked strap end to anchor the stake in position.

As seen in FIG. 9, further sandbags may be placed over the cover in an interlocking, evenly distributed sequence over the entire cover and the straps 14. A trench (not shown) should be dug from the cover away from the foxhole to divert water.

Figure 11:
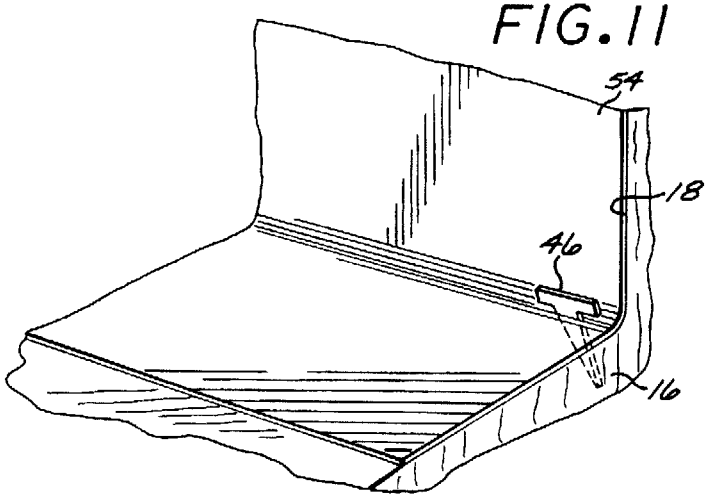
FIG. 11 is an enlarged view taken in the area indicated by the arrow and numeral 11 in FIG. 9.

If desired, the pair of oppositely facing revetment curtains or sheets 54, as best seen in FIGS. 9–11, are suspended from the opposite extremities of the cover 10, respectively, as previously explained. The sheets 54 engage the opposite sides of the foxhole.

The lower extremities of the suspended sheets 54 are made long enough to extend inwardly a short distance over the floor of the foxhole. There they are fixed in position by stakes 46 preferably held down by sandbags 56 or stakes 46, or both. With this arrangement the revetment sheets 54 tend to prevent collapse of the foxhole sidewalls, the loads on the sheets 54 being transmitted to the stakes at the bottom of the foxhole, and to the straps and cover structure overlying the foxhole.

From the foregoing it will be appreciated that the cover of the present invention is waterproof, easily portable, quickly deployable to shield the occupants of a foxhole from direct and indirect fire such as overpressure from near-misses, and adapted to bear the considerable weight of protective material such as earth and sand piled on top of the cover. The configuration of the tubular frame structure of the cover is characterized by optimum load beating capacity, and is so coupled to anchoring means or straps that the cover is maintained, which is particularly important as a safety means to prevent the cover from falling downwardly onto the foxhole occupants in the event of collapse of the foxhole sidewalls.

While a particular form of the invention has been illustrated and described, it will be apparent that various modifications can be made without departing from the spirit and scope of the invention. It will also be apparent that while the invention has been described with respect to a foxhole cover, the principles of the invention could readily be embodied in covers serving as suspension foot bridges.

What is claimed is:

1. A portable cover for placement across the sides of a military, trench or foxhole dug in the ground, the cover comprising:

elongated frame means defining a rigid structure resistant to longitudinal bending;

load beating sheet means attached to and overlying the frame means for transmitting loads to the frame means whereby the weight of protective material such as sandbags or timber placed on the cover is borne by the frame means; and elongated substantially inextensible strap means attached to the frame means and extending beyond the frame means for securement to the ground whereby the strap means are placed in tension between the ground and the frame means to support the frame means upon any downward movement of the frame means toward the foxhole.

2. A portable cover according to claim 1 wherein the strap means comprises a plurality of continuous straps extending through the frame means.

3. A portable cover according to claim 1 and including anchorage means coextensive with the frame means; and wherein the frame means comprises a pair of elongated frames coupled to the anchorage means and operative to pivot toward each other on the anchorage means into compact relation whereby transportation of the cover is facilitated when not in use.

4. A portable cover according to claim 3 wherein the pair of elongated frames are arranged in side-by-side relation, and the anchorage means comprises a substantially rectangular high strength waterproof fabric anchorage sheet extending outwardly of the frames to form flaps, and including fastening strap means encircling the frames whereby the frames are secured together in waterproof relation for such transportation, and whereby the cover provides waterproof protection when the cover is located over the foxhole.

5. A portable cover according to claim 2 and including a plurality of apertured fittings attached to the ends of the straps; and a plurality of stakes attached to the straps for driving through the apertures to stake the straps to the ground.

6. A portable cover according to claim 1 wherein the frame means comprises one or more elongated frames wherein each frame includes a pair of elongated and parallel upper members located in a first plane; a pair of elongated and parallel lower members located in a second plane below and parallel to the first plane, the lower members being located laterally outwardly of the upper members; a plurality of intermediate cross members spaced longitudinally along the length of the upper members, and having horizontal portions located substantially in the first plane and attached to the upper members, and further having integral diagonal portions extending from the upper members and connected to the lower members, respectively; and a pair of end cross members connected to the ends of the lower members.

7. A portable cover according to claim 6 wherein the upper members, the lower members, the intermediate cross members, and the end cross members are made of tubular high strength tubing.

8. A portable cover according to claim 7 wherein the tubing is made of aluminum tubing having a wall thickness of approximately 0.065 inches.

9. A portable cover according to claim 7 wherein the tubing is made of steel having a wall thickness of approximately 0.035 inches.

10. A portable cover according to claim 6 wherein the end extremities of the upper members take the form of sloping end portions which are attached to the ends of the end cross members, respectively; and wherein the load bearing sheet means comprises an elongated and rectangular load bearing sheet engaged at its sides upon the upper members for transferring loads to the frame, the load bearing sheet being sloped downwardly at its points of engagement with the diagonal portions of the upper members; and including a substantially rectangular high strength waterproof fabric anchorage sheet overlying and conforming to the contour of the upper members, including the diagonal portions of the upper members, thereby to facilitate water runoff from the cover.

11. A portable cover according to claim 6 wherein the frame means comprises a pair of frames, and the strap means comprises a plurality of elongated flexible straps extending through the frame, with the straps underlying all of the intermediate cross members whereby the cross members transmit the weight of the cover to the strap means in the event of collapse of the foxhole sides.

12. A portable cover according to claim 1 and including revetment sheets adapted for engagement with the sides of the foxhole; and support means connected to the sheets and to the strap means.

13. A soldier fighting cover for placement across the sides of a military trench or foxhole dug in the ground, the cover comprising:

a pair of elongated rigid frames, each of the frames comprising a pair of elongated and parallel upper members located in a first plane, a pair of elongated and parallel lower members located in a second plane below and parallel to the first plane, the lower members being located laterally outwardly of the upper members, a plurality of intermediate cross members spaced longitudinally along the length of the upper members, and having horizontal portions located substantially in the first plane and attached to the upper members, and further having integral diagonal portions extending from the upper members and connected to the lower members, respectively, and a pair of end cross members connected to the ends of the lower members;

load bearing sheets engaged upon and overlying the upper members of the frame, respectively, and attached at their opposite ends to the pair of end cross members, respectively, the end extremities of each of the sheets including adjacent slits generally horizontally aligned with the upper surfaces of the intermediate cross members;

a plurality of elongated substantially inextensible high strength flexible straps attached to the frames and extending through and beyond the ends of the frames for securement to the ground, the straps passing through the slits in the load bearing sheets, and passing under the intermediate cross members whereby the straps are placed in tension between the ground and the frames to support the frames upon any downward movement of the frames toward the foxhole.

14. A soldier fighting cover according to claim 13 and including a substantially rectangular high strength waterproof fabric anchorage sheet attached to and overlying the frames to catch and drain off rainwater when the cover is located over the foxhole.

15. A soldier fighting cover according to claim 13 and including a plurality of apertured fittings attached to the ends of the straps, and further including a plurality of stakes attached to the straps for driving through the apertures to stake the straps to the ground.

16. A soldier fighting cover according to claim 14 wherein the end extremities of the upper members take the form of sloping end portions which are attached to the ends of the end cross members, respectively, and wherein the load bearing sheets are engaged upon the sloping end portions to facilitate water runoff from the cover.

17. A soldier fighting cover according to claim 13 wherein the upper members, the lower members, the intermediate cross members, and the end cross members are made of tubular high strength tubing.

18. A soldier fighting cover according to claim 13 wherein the tubing is made of aluminum tubing having a wall thickness of approximately 0.065 inch.

19. A soldier fighting cover according to claim 13 wherein the tubing is made of steel having a wall thickness of approximately 0.035 inch.

20. A soldier fighting cover according to claim 13 and including support means carried by the strap means, the support means being adapted for connection to revetment sheets for engagement with the sides of the foxhole to constrain the side against collapse, the support means being located adjacent the slits, respectively, thereby constraining the straps against longitudinal movement.

* * * * *